US010795303B2

(12) United States Patent
Ebihara

(10) Patent No.: US 10,795,303 B2
(45) Date of Patent: Oct. 6, 2020

(54) METHOD OF ESTIMATING LIFETIME OF CONVEYANCE PART PROVIDED IN IMAGE FORMING APPARATUS

(71) Applicant: CANON KABUSHIKI KAISHA, Tokyo (JP)

(72) Inventor: Shun-ichi Ebihara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/504,056

(22) Filed: Jul. 5, 2019

(65) Prior Publication Data

US 2020/0019105 A1 Jan. 16, 2020

(30) Foreign Application Priority Data

Jul. 10, 2018 (JP) ..... 2018-130882

(51) Int. Cl.

| | |
|---|---|
| ***G03G 15/00*** | (2006.01) |
| ***B65H 43/02*** | (2006.01) |
| ***B65H 43/06*** | (2006.01) |

(52) U.S. Cl.

CPC ..... *G03G 15/553* (2013.01); *B65H 43/02* (2013.01); *B65H 43/06* (2013.01); *G03G 15/5029* (2013.01)

(58) Field of Classification Search

CPC .. G03G 15/553; G03G 15/5029; B65H 43/02; B65H 43/06

See application file for complete search history.

(56) References Cited

U.S. PATENT DOCUMENTS 9,488,948 B2 * 11/2016 Kitamura ..... G03G 21/203

FOREIGN PATENT DOCUMENTS

| | | | |
|---|---|---|---|
| JP | 03-042447 | A | 2/1999 |
| JP | 2014-178344 | A | 9/2014 |
| JP | 2015-175920 | A | 10/2015 |
| JP | 2015-206877 | A | 11/2015 |
| JP | 2018-100181 | A | 6/2018 |

* cited by examiner

*Primary Examiner* — Hoang X Ngo
(74) *Attorney, Agent, or Firm* — Venable LLP

(57) ABSTRACT

In an image forming apparatus, a first conveyance part conveys a sheet, a detection unit detects a leading edge of the sheet conveyed by the first conveyance part, a second conveyance part is provided downstream of the detection unit in a conveyance direction of the sheet and conveys the sheet, a measurement unit measures a conveyance time of the sheet from when conveyance of the sheet by the first conveyance part is started until the leading edge of the sheet is detected by the detection unit, and an estimation unit estimates a remaining lifetime of the second conveyance part based on the conveyance time measured by the measurement unit.

19 Claims, 10 Drawing Sheets

FIG. 4A

| NUMBER OF PRINTED SHEETS Np | CORRECTION COEFFICIENT Ps |
|---|---|
| 0≤Np<40,000 | 1.00 |
| 40,000≤Np<50,000 | 0.90 |
| 50,000≤Np<60,000 | 0.80 |
| 60,000≤Np<70,000 | 0.75 |
| 70,000≤Np | 0.70 |

FIG. 4B

| NUMBER OF PRINTED SHEETS Np | CORRECTION COEFFICIENT Ps |
|---|---|
| 0≤Np<30,000 | 1.00 |
| 30,000≤Np<35,000 | 0.90 |
| 35,000≤Np<40,000 | 0.80 |
| 40,000≤Np<45,000 | 0.75 |
| 45,000≤Np | 0.70 |

METHOD OF ESTIMATING LIFETIME OF CONVEYANCE PART PROVIDED IN IMAGE FORMING APPARATUS

BACKGROUND OF THE INVENTION

Field of the Invention

The present invention relates to a method of estimating the lifetime of a conveyance part provided in an image forming apparatus.

Description of the Related Art

An image forming apparatus has a plurality of consumables that need to be replaced. By replacing a consumable at an appropriate time, the image forming apparatus can form images of an expected quality. Japanese Patent Laid-Open No. 3-42447 proposes measuring the conveyance time required for a sheet to be conveyed in a predetermined conveyance section, and indicating that the lifetime of a conveyance part has been exhausted when the conveyance time exceeds a predetermined value. Japanese Patent Laid-Open No. 2014-178344 proposes obtaining a degree of degradation of a conveyance part (abrasion amount of a releasability layer) from the smoothness and basis weight of sheets conveyed by the conveyance part.

In Japanese Patent Laid-Open No. 3-42447, it is determined that the lifetime of a conveyance part such as a pickup roller installed in a portion of a conveyance section in a conveyance path has been exhausted by measuring the conveyance time of sheets in the conveyance section. Therefore, the lifetime of films, rollers, etc. of a fixing device which is not installed in this partial conveyance section and which does not contribute to the measured conveyance time is not determined. In contrast, Japanese Patent Laid-Open No. 2014-178344 does not require a sensor for measuring conveyance time, but instead requires a sensor for detecting the smoothness and basis weight of sheets. Furthermore, Japanese Patent Laid-Open No. 2014-178344 estimates an abrasion amount of a releasability layer of a fixing belt from the smoothness or basis weight of sheets, and the number of sheets that are fed, but does not consider conveyance time. However, since the smoothness and basis weight of sheets are more indirect indicators of part degradation than conveyance time, the estimation error of the remaining lifetime of the conveyance part can be large. Therefore, there is a need for a method for accurately obtaining the remaining lifetime of a conveyance part that is not related to a conveyance time measurement.

SUMMARY OF THE INVENTION

The present invention provides an image forming apparatus comprising the following elements. A first conveyance part conveys a sheet. A detection unit detects a leading edge of the sheet conveyed by the first conveyance part. A second conveyance part is provided downstream of the detection unit in a conveyance direction of the sheet, and conveys the sheet. A measurement unit measures a conveyance time of the sheet from when conveyance of the sheet by the first conveyance part is started until the leading edge of the sheet is detected by the detection unit. An estimation unit estimates a remaining lifetime of the second conveyance part based on the conveyance time measured by the measurement unit.

Further features of the present invention will become apparent from the following description of exemplary embodiments (with reference to the attached drawings).

BRIEF DESCRIPTION OF THE DRAWINGS

FIGS. 4A and 4B are tables illustrating a relationship between a number of printed sheets and a correction coefficient.

DESCRIPTION OF THE EMBODIMENTS

First Embodiment

In this embodiment, a conveyance time (conveyance speed) of a sheet is measured by a first conveyance part, and a degree of degradation of a second conveyance part differing from the first conveyance part is estimated on the basis of this conveyance time. This eliminates the need to directly obtain the conveyance time of the second conveyance part. A level of degradation (a remaining lifetime) of the second conveyance part is indirectly obtained from the conveyance time of sheets according to the first conveyance part.

Image Forming Apparatus

Figure 1:
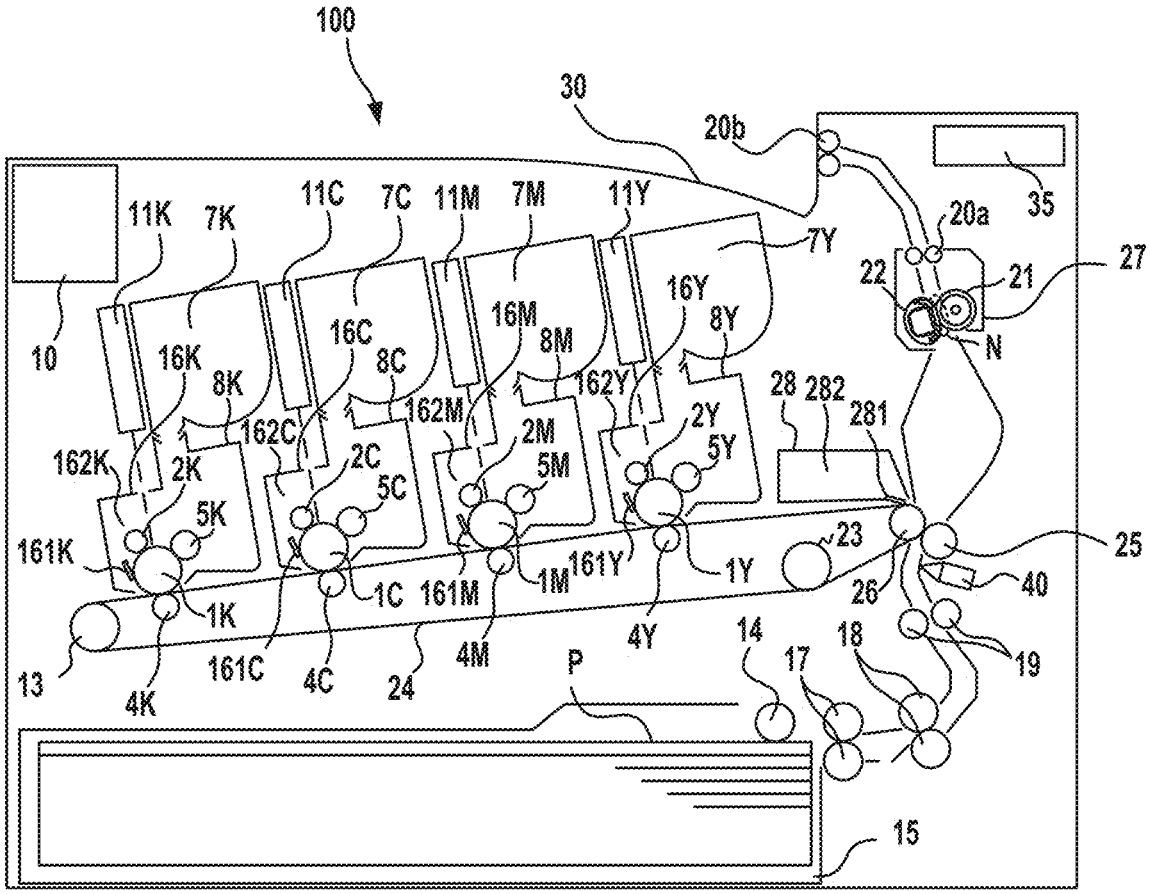
FIG. 1 is a schematic cross-sectional view of an image forming apparatus.

Although FIG. 1 shows a schematic cross-section of an image forming apparatus 100 for forming a color image, the present invention is also applicable to an image forming apparatus for forming a monochrome image. The image forming apparatus 100 is a four-drum full-color printer and is equipped with a duplex printing mechanism. The image forming unit has four stations corresponding to yellow (Y), magenta (M), cyan (C), and black (K), respectively. Note that the YMCK letters given at the end of the reference numerals indicate the colors of the toners, and are omitted when matter common for the four colors is explained. A photosensitive drum 1 is an image carrier for carrying an electrostatic latent image or a toner image. A charging roller 2 charges the surface of the photosensitive drum 1 to a uniform potential. An exposure unit 11 outputs light corresponding to the image signal, and scans the light on the surface of the photosensitive drum 1 to form an electrostatic latent image. A developing device 8 develops the electrostatic latent image using toner to form a toner image. The developing device 8 has a developing roller 5 for supplying toner to the electrostatic latent image. The toner container 7 supplies toner to the developing device 8. A primary transfer roller 4 transfers the toner image carried on the photosensitive drum 1 to the intermediate transfer belt 24. A drum cleaner 16 scrapes toner that remains on the photosensitive drum 1 without being transferred from the photosensitive drum 1 to the intermediate transfer belt 24 by the cleaner blade 161, and collects the toner into a toner collecting container 162. The intermediate transfer belt 24 is stretched around a driving roller 26, a tension roller 13, an auxiliary roller 23, and a primary transfer roller 4. The intermediate transfer belt 24 is an intermediate transfer member that rotates by being driven by a driving roller 26.

Upon receipt of an image signal, the control calculation unit 10 drives the pickup roller 14 to feed a sheet P from a feed cassette 15. Feed roller pairs 17 and 18 are pairs of conveying rollers for conveying the sheet P further downstream in the conveyance direction of the sheet P. The registration roller pair 19 is a pair of conveying rollers arranged downstream of the feed roller pairs 17 and 18 in the conveyance direction of the sheet P. The feed roller pairs 17 and 18 convey the sheet P so that a toner image and the sheet P reach the secondary transfer roller 25 at the same time. A sensor 40 may be disposed between the registration roller pair 19 and the secondary transfer roller 25 to detect that the sheet P has reached or been added to the registration roller pair 19.

The control calculation unit 10 controls the image forming apparatus 100 in accordance with commands inputted from the control panel 35 or a host computer (not shown). For example, the control calculation unit 10 has a timer for measuring a conveyance time T from the start of driving of the pickup roller 14 until the sheet P reaches the registration roller pair 19, and a memory for storing transition of the conveyance time T.

The intermediate transfer belt 24, the driving roller 26, and the secondary transfer roller 25 form a secondary transfer unit. The secondary transfer unit transfers the toner image conveyed by the intermediate transfer belt 24 onto the sheet P. A belt cleaner 28 removes the toner remaining on the intermediate transfer belt 24 by a cleaner blade 281, and collects the toner in a cleaner container 282.

A fixing device 27 has a pressure roller 21 and a heating rotary member 22, and applies heat and pressure to the toner image to fix the toner image to the sheet P. The discharge rollers 20*a* and 20*b* discharge the sheets P discharged from the fixing nip N to the discharge tray 30.

Fixing Device

Figure 2:
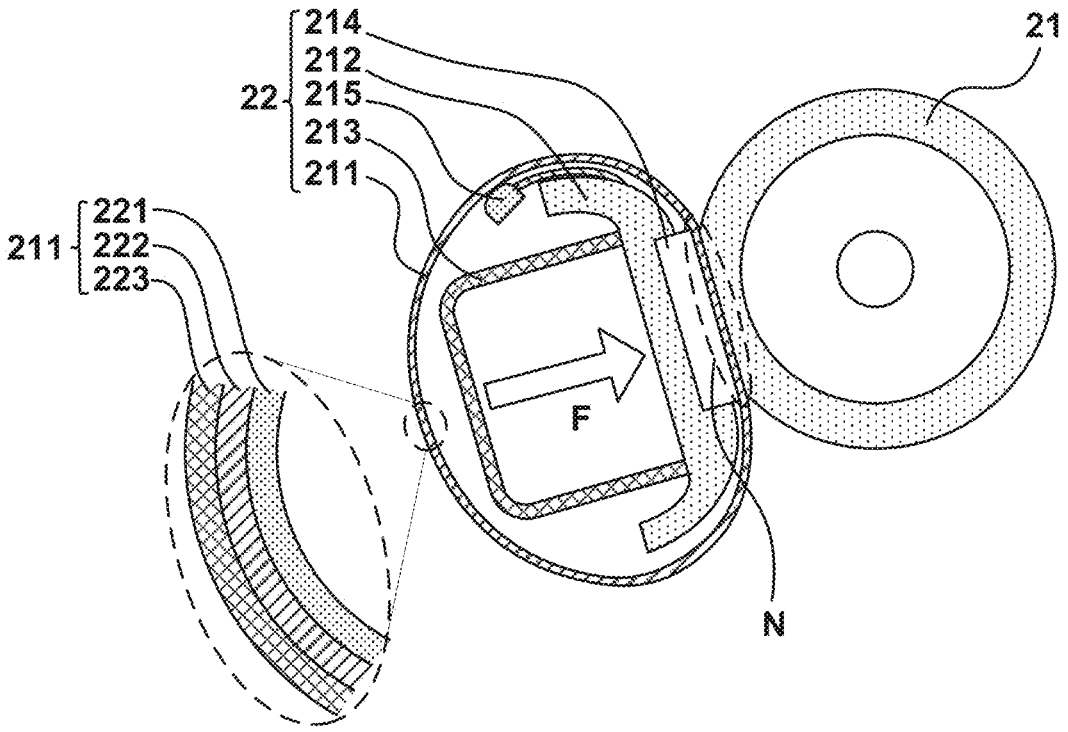
FIG. 2 is an overview configuration diagram of a fixing device.

FIG. 2 shows a schematic configuration of the fixing device 27. The heating rotary member 22 has a cylindrical heating film 211 having heat resistance. The heating film 211 is fitted to a support holder 212 and a fixing stay 213. The support holder 212 holds the heating film 211 in a cylindrical shape. The fixing stay 213 is a metallic stay that holds the support holder 212. Mounted longitudinally on the support holder 212 is a plate-shaped heating member 214. The plate-shaped heating member 214 forms a fixing nip N with the pressure roller 21 and a pressurization force F via the heating film 211. The heating film 211, which is sandwiched between the pressure roller 21 and the plate-shaped heating member 214, rotates around the support holder 212 and the fixing stay 213 in accordance with the pressure roller 21. A temperature sensor 215 is in contact with the inner surface of the heating film 211. The temperature sensor 215 detects the inner surface temperature of the heating film 211. The control calculation unit 10 controls the temperature of a heater so that the inner surface temperature becomes the target temperature.

As an example, the heating film 211 includes a metal film 221, an elastic layer 222, and a releasability layer 223. The metal film 221 is a stainless-steel material having a thickness of 35 [um] and functions as a base layer. um is an abbreviation for micrometer. The elastic layer 222 is a thermally conductive silicone rubber laminated onto the metal film 221. The thickness of the elastic layer 222 is 300 [um]. The releasability layer 223 is laminated on the elastic layer 222 and is a 25 [um] thick layer comprising a PFA (perfluoroalkoxy alkane) material.

Lifetime Estimation of Conveyance Part

The control calculation unit 10 performs an estimation calculation of the lifetime of the fixing device 27 by estimating an amount of abrasion of the releasability layer 223 of the heating film 211. For convenience of explanation, the standard value Ab of the amount of abrasion of the releasability layer 223 by conveyance is 0.84×10^−4 [um] per page regardless of the size of the sheet P. ^ is an arithmetic symbol representing a power. The control calculation unit 10 multiplies the standard value Ab by a correction coefficient Ps to obtain and accumulate the amount of abrasion for each conveyance of one sheet P. The correction coefficient Ps is a correction coefficient corresponding to the type of the sheet P. An accumulated amount of abrasion A is obtained from the following equation.

$$A=\Sigma(Ab\times Ps) \quad (1)$$

The correction coefficient Ps is an index indicating how much the wear of the releasability layer 223 is accelerated by the sheet P. The correction coefficient Ps varies depending on the type (brand) of the sheet P, such as the smoothness and stiffness of the surface of the sheet P, and the material and quantity of an additive to the sheet P. Therefore, the control calculation unit 10 decides the correction coefficient Ps based on the conveyance time T from the start of driving the pickup roller 14 until the sheet P reaches the registration roller pair 19. That is, if the sheet P has characteristics that tend to accelerate the wear of the conveyance part, an increase in the conveyance time T caused by the wear of the pickup roller 14 and the feed roller pairs 17 and 18 (i.e., the change in the outer diameter) occurs at a relatively early stage of the total operating time of the image forming apparatus 100. When such a sheet P is used, the wear of the releasability layer 223 of the heating film 211 in the fixing device 27 is also accelerated, similarly to the pickup roller 14 and the feed roller pairs 17 and 18. In contrast, when the sheet P has a characteristic of hardly accelerating the wear of the conveyance part, the conveyance time T is hardly increased, and the wear of the releasability layer 223 also increases gradually.

Figure 3A:
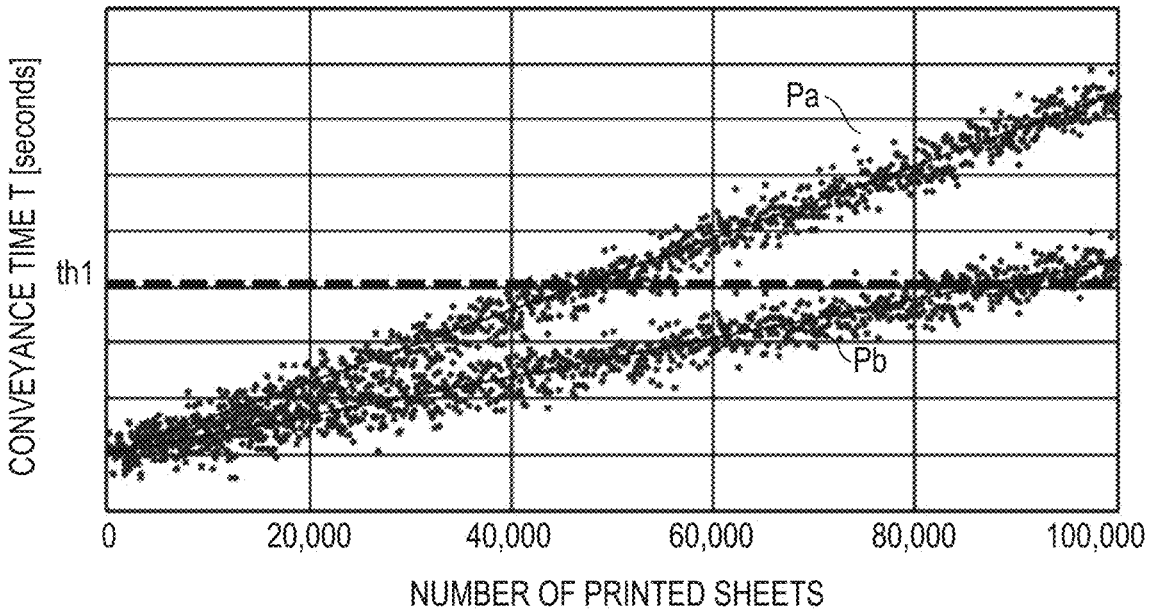
FIGS. 3A and 3B are views showing the relationship between a number of printed sheets and conveyance time.

FIG. 3A shows the transition of the conveyance time T when two types of sheets Pa and Pb are continuously used in respectively different image forming apparatuses 100. The sheet Pa has a characteristic of tending to accelerate the wear of a conveyance part. When an image forming apparatus 100 that is in a new product state forms images on approximately 40,000 sheets Pa, the conveyance time T exceeds the threshold value th1. In contrast, the sheet Pb has a characteristic of hardly accelerating wear. The timing at which the conveyance time T exceeds the threshold value th1 for the sheet Pb is a timing when images have been formed on 75,000 sheets Pb.

FIG. 4A shows a table in which the correction coefficient Ps for a number of printed sheets Np is stored. The number of printed sheets Np is the cumulative number of sheets P on which the image forming apparatus 100 has formed images from a new product state until the conveyance time T exceeds the threshold value th1. FIG. 4A shows that, in this case, the correction coefficient Ps is selected from a range between 0.70 and 1.00, depending on the number of printed sheets Np. If the threshold value th1 is reached with a relatively small number of printed sheets Np using a sheet P that tends to facilitate wear, such as a sheet Pa, then 1.00 is selected as the correction coefficient Ps. If the threshold value th1 is not reached until a relatively large number of printed sheets Np using a sheet P that hardly accelerates wear like the sheet Pb, 0.70 is selected as the correction coefficient Ps.

In the period until the conveyance time T exceeds the threshold value th1, 1.00 which is an initial value is set as the correction coefficient Ps. The control calculation unit 10 calculates a temporary accumulated amount of abrasion A based on the initial value. When the conveyance time T exceeds the threshold value th1, the control calculation unit 10 determines the correction coefficient Ps based on the table and multiplies the temporary accumulated amount of abrasion A by the correction coefficient Ps. Thereafter, the control calculation unit 10 calculates the accumulated amount of abrasion A according to Equation (1).

The control calculation unit 10 executes a lifetime calculation based on the accumulated amount of abrasion A. In the lifetime calculation, a calculation is performed to indicate in percentage how close the accumulated amount of abrasion A is to a predetermined lifetime value. When the thickness of the releasability layer 223 becomes extremely thin due to wear, minute cracks occur in the releasability layer 223. In this case, a releasability effect deteriorates, and image quality also deteriorates. Therefore, the lifetime value Az of the accumulated amount of abrasion A is set to 23 [um] for the thickness of 25 [um] of the releasability layer 223 when it is a new product. In such a case, when the thickness of the releasability layer 223 becomes 2 [um], it is determined that the lifetime of the heating film 211 is exhausted. The control calculation unit 10 may calculate the remaining lifetime L of the fixing device 27 using Equation (2).

$$L=(1-(A/Az))\times 100 \quad (2)$$

The control calculation unit 10 displays a calculation result of the remaining lifetime L [%] on the control panel 35 and notifies the user of the calculation result. The control calculation unit 10 may predict the estimation value Nx of the lifetime number of sheets from the following equation.

$$Nx=Az/(Ab\times Ps) \quad (3)$$

Effect

Figure 5A:
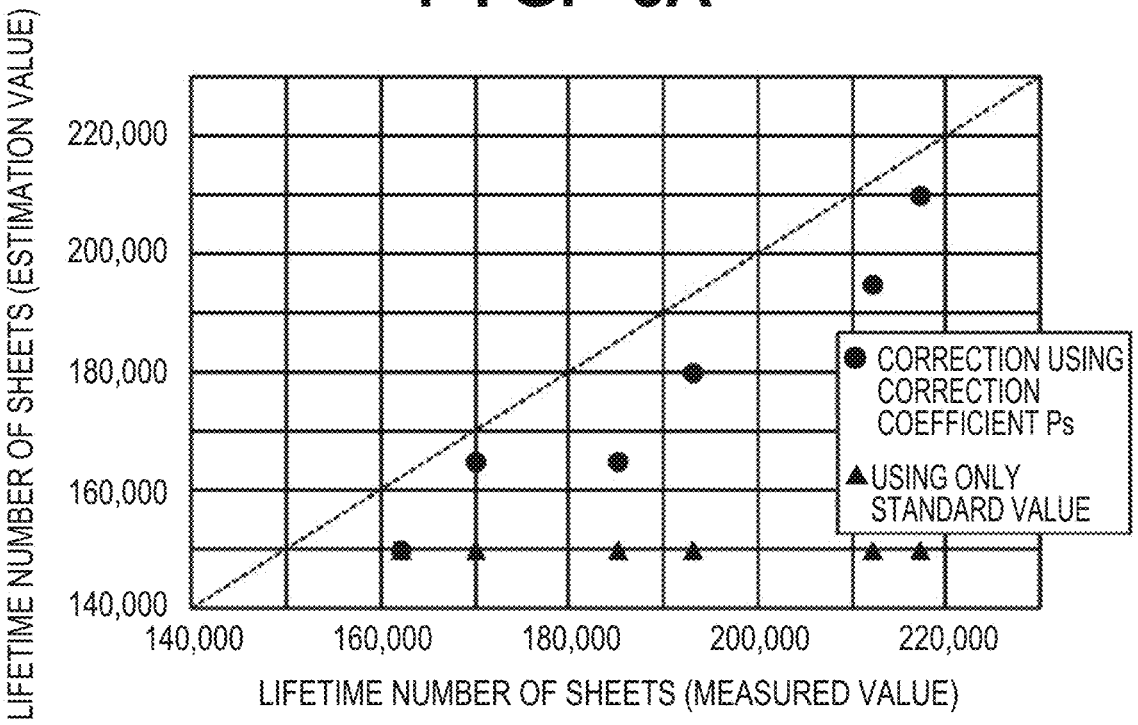
FIGS. 5A and 5B are views illustrating experimental results.

FIG. 5A is a diagram showing a measured value of a lifetime number of sheets and an estimation value Nx of a lifetime number of sheets, obtained by the control calculation unit 10. Here, an estimation value obtained using the correction coefficient Ps and estimation value obtained using only the standard value Ab are plotted. It can be seen from FIG. 5A that the estimation value obtained by using the correction coefficient Ps is closer to a measured value than the estimation value obtained by using only the standard value Ab.

In this manner, by selecting the correction coefficient Ps in accordance with the wear characteristics (conveyance time T) of the sheet P and obtaining the accumulated amount of abrasion A while correcting the amount of abrasion using the correction coefficient Ps, the lifetime of the conveyance part that contacts the sheet P to convey the sheet P can be accurately estimated. The remaining lifetime of the fixing device 27 which is not involved in the conveyance time T can also be estimated indirectly based on the conveyance time T.

Flowchart

Figure 6:
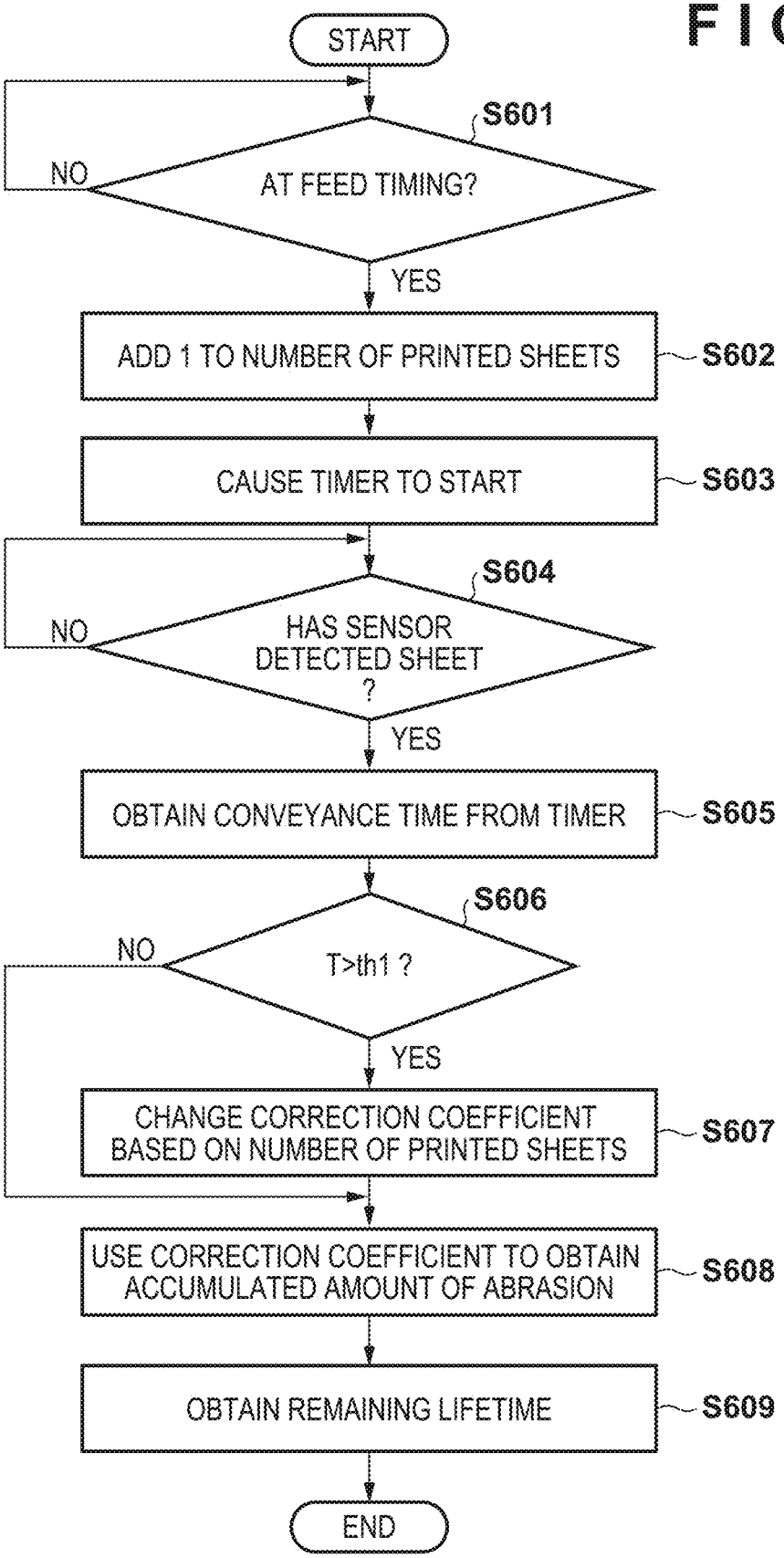
FIG. 6 is a flow chart indicating a method of calculating a remaining lifetime.
Figure 7:
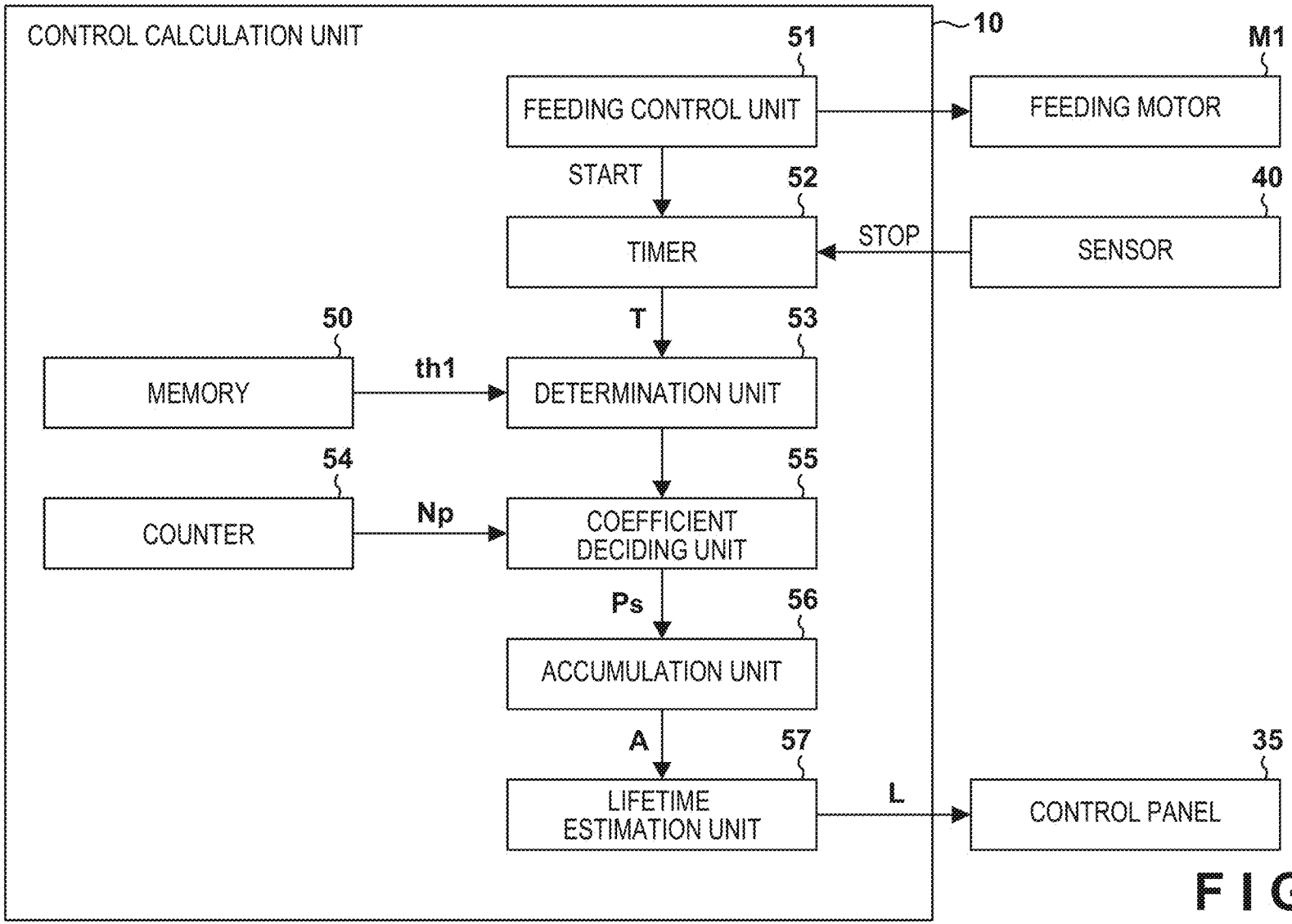
FIG. 7 is a block diagram illustrating functions of a control calculation unit.

FIG. 6 is a flow chart illustrating the lifetime estimation method performed by the control calculation unit 10. FIG. 7 shows calculation functions of the control calculation unit 10. The calculation functions may be realized by the CPU executing control programs stored in the ROM or the like, or may be realized by hardware such as an ASIC or an FPGA. CPU is an abbreviation for central processing unit. ROM is an abbreviation for read-only memory. ASIC is an abbreviation for Application Specific Integrated Circuit. FPGA is an abbreviation for Field Programmable Gate Array.

In step S601, a feeding control unit 51 of the control calculation unit 10 determines whether or not a feed timing has arrived based on a print job. The feed timing is a time at which a sheet P is fed from the feed cassette 15. When feed timing arrives, the control calculation unit 10 starts driving the feeding motor M1 and proceeds to step S602. The feeding motor M1 is a motor for driving the pickup roller 14.

In step S602, the feeding control unit 51 outputs an addition signal to the counter 54, so that the counter 54 adds 1 to the number of printed sheets Np. In step S603, the feeding control unit 51 outputs a start signal to a timer 52, whereby the timer 52 starts measuring the conveyance time T. In step S604, the control calculation unit 10 determines whether or not the sensor 40 has detected the leading edge of the sheet P. When the sensor 40 detects the leading edge of the sheet P, the control calculation unit 10 proceeds to step S605. A detection signal outputted when the sensor 40 detects the leading edge of the sheet P may be used as a stop signal for stopping the timer 52.

In step S605, a determination unit 53 of the control calculation unit 10 obtains the conveyance time T from the timer 52. In step S606, the determination unit 53 determines whether or not the conveyance time T exceeds the threshold value th1. The threshold value th1 is stored in the ROM in the memory 50. If the conveyance time T exceeds the threshold value th1, the control calculation unit 10 proceeds to step S607. If the conveyance time T does not exceed the threshold value th1, the control calculation unit 10 skips step S607 and proceeds to step S608.

In step S607, a coefficient deciding unit 55 decides the correction coefficient Ps based on the number of printed sheets Np counted by the counter 54. The memory 50 may include tables or functions for converting the number of printed sheets Np into the correction coefficient Ps. In step S608, an accumulation unit 56 obtains the accumulated amount of abrasion A using the correction coefficient Ps. The accumulated amount of abrasion A is stored in the memory 50. The accumulated amount of abrasion A may be calculated based on Equation (1). In step S609, a lifetime estimation unit 57 obtains the remaining lifetime L based on the accumulated amount of abrasion A. The remaining lifetime L may be calculated based on Equation (2). The lifetime estimation unit 57 may display the remaining lifetime L on the display of the control panel 35. The lifetime estimation unit 57 may also obtain the estimation value Nx of the lifetime number of sheets and display it on the display.

Variation

In the above explanation, the conveyance time T is measured for each sheet, and the correction coefficient Ps is calculated. The correction coefficient Ps may be calculated at different times. For example, control calculation unit 10 may count the number of printed sheets using the counter 54 and, when number of printed sheets reaches a predetermined number of sheets, execute measurement of the conveyance time T and calculation of the correction coefficient Ps. This will reduce the computational burden on the control calculation unit 10.

An accumulated amount of abrasion A is calculated on the basis of an amount of abrasion (standard value Ab) per page, and moreover the amount of abrasion is assumed to be a constant value independent of the size of the sheet P. However, this is only an example. For example, the amount by which the conveyance part is abraded when the conveyance part makes one revolution may be used as a reference. The smaller the size of the sheet P, the fewer the number of revolutions of the conveyance part required to convey one sheet P. Therefore, the control calculation unit 10 may measure the number of revolutions of the conveyance part by a counter and multiply the amount of abrasion of the conveyance part per revolution by the number of revolutions and the correction coefficient Ps to obtain the accumulated amount of abrasion A. This will improve the accuracy of lifetime estimation in an image forming apparatus 100 which forms images on sheets P that are relatively smaller in size.

In the above explanation, for the correction coefficient Ps, the conveyance time T from the start of the driving of the pickup roller 14 until the sheet P reaches the registration roller portion is used. However, other parameters may be employed as parameters correlated with the wear characteristics of the sheet P. For example, the conveyance time T required for the sheet P to be conveyed in any two places in the conveyance path of the sheet P may be measured. In this case, a first sheet sensor and a second sheet sensor for detecting the presence or absence of the sheet P are respectively disposed at these two positions. The first sheet sensor is disposed upstream of the second sheet sensor in the conveyance direction of the sheet P. The control calculation unit 10 measures, by timer or counter, the conveyance time T from the timing at which the first sheet sensor detects the leading edge of the sheet P to the timing at which the second sheet sensor detects the leading edge of the sheet P. The control calculation unit 10 determines the correction coefficient Ps based on the measured conveyance time T.

In the above explanation, the conveyance time T varies depending on a level of abrasion of the pickup roller 14 and the feed roller pairs 17 and 18. That is, it is assumed that the level of abrasion of the heating film 211 correlates with the level of abrasion of the pickup roller 14 and the feed roller pairs 17 and 18. The conveyance time T is measured using the sensor 40. Here, the feed roller pairs 17 and 18 may have a driving roller which is driven by a motor and a driven roller that rotates in accordance with the sheet P conveyed by the driving roller. In this instance, the control calculation unit 10 may measure the rotation speed of the driven roller using a sensor such as an encoder, and convert the measured rotation speed into the conveyance speed V of the sheet P. The conveyance speed V is also a parameter related to the wear characteristics of the sheet P. The greater the amount of abrasion of the conveyance part by the sheets P, the lower the conveyance speed V. The control calculation unit 10 may convert the conveyance speed V into the correction coefficient Ps by using a function, a table, and the like.

In the above description, the remaining lifetime L was a percentage value indicating how close the accumulated amount of abrasion has come to the lifetime value, but this is only an example of a numerical value that indicates the lifetime of the conveyance part. For example, the remaining lifetime L may be the number of sheets P that can be conveyed until the lifetime of the conveyance part is exhausted. Alternatively, the remaining lifetime L may be the lifetime number of days of the conveyance part, obtained by taking into account a number of sheets printed by the image forming apparatus 100 each day.

The control calculation unit 10 causes the control panel 35 to indicate the lifetime of the conveyance part, but this is merely an example. Configuration may be such that the control calculation unit 10 has a communication circuit that is connected to a network and notifies a computer connected via the network of the lifetime. The computer may be a user terminal or a management terminal that manages the image forming apparatus 100.

Second Embodiment

In the first embodiment, the correction coefficient Ps is obtained when the conveyance time T reaches the threshold value th1. In the second embodiment, the correction coefficient Ps is obtained at a plurality of timings. In the second embodiment, description of matter shared with the first embodiment is omitted.

Figure 3B:
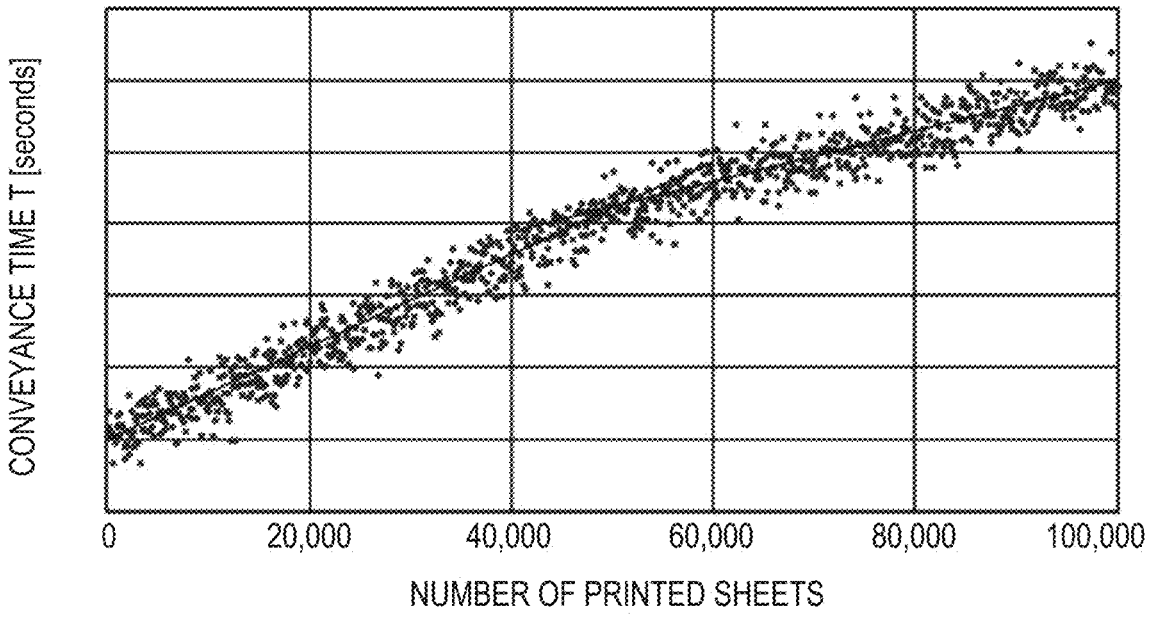

FIG. 3B shows a transition of the conveyance time T which is measured using the image forming apparatus 100. In this example, sheets Pa are used from 0 to 50,000 printed sheets, and sheets Pb are used from 50,001 printed sheets onward. Therefore, the tendency of the conveyance time T (may be referred to as a slope or transition) varies at around 50,000 sheets. As described above, when the type of the sheet P is changed depending on the convenience of the user or the material of the rollers constituting the image forming apparatus 100 is changed, the tendency of the conveyance time T is also changed. Therefore, the control calculation unit 10 may obtain the correction coefficient Ps at a plurality of timings until the conveyance part that is the target of the lifetime calculation reaches its lifetime.

The control calculation unit 10 measures a moving average Ta of the conveyance time T for a sheet P of a predetermined number of sheets Nz (e.g., 100 sheets), obtains an amount of change dTa from the moving average Ta, and compares the amount of change dTa with a plurality of threshold values ta1 to ta3. Each time the amount of change dTa exceeds the threshold values ta1 to ta3, the control calculation unit 10 calculates the correction coefficient Ps.

Here, the reason why the moving average Ta and the amount of change dTa are used is as follows. Since three threshold values ta1 to ta3 are used, the amount of change of the conveyance time T in the second embodiment is smaller than the amount of change of the conveyance time T in the first embodiment. As a result, the effects of measurement variation of the conveyance time T and individual variation of the initial value of the conveyance time T cannot be ignored. Therefore, the moving average Ta and amount of change dTa are used in order to reduce the effect of the variation.

Flowchart

Figure 8:
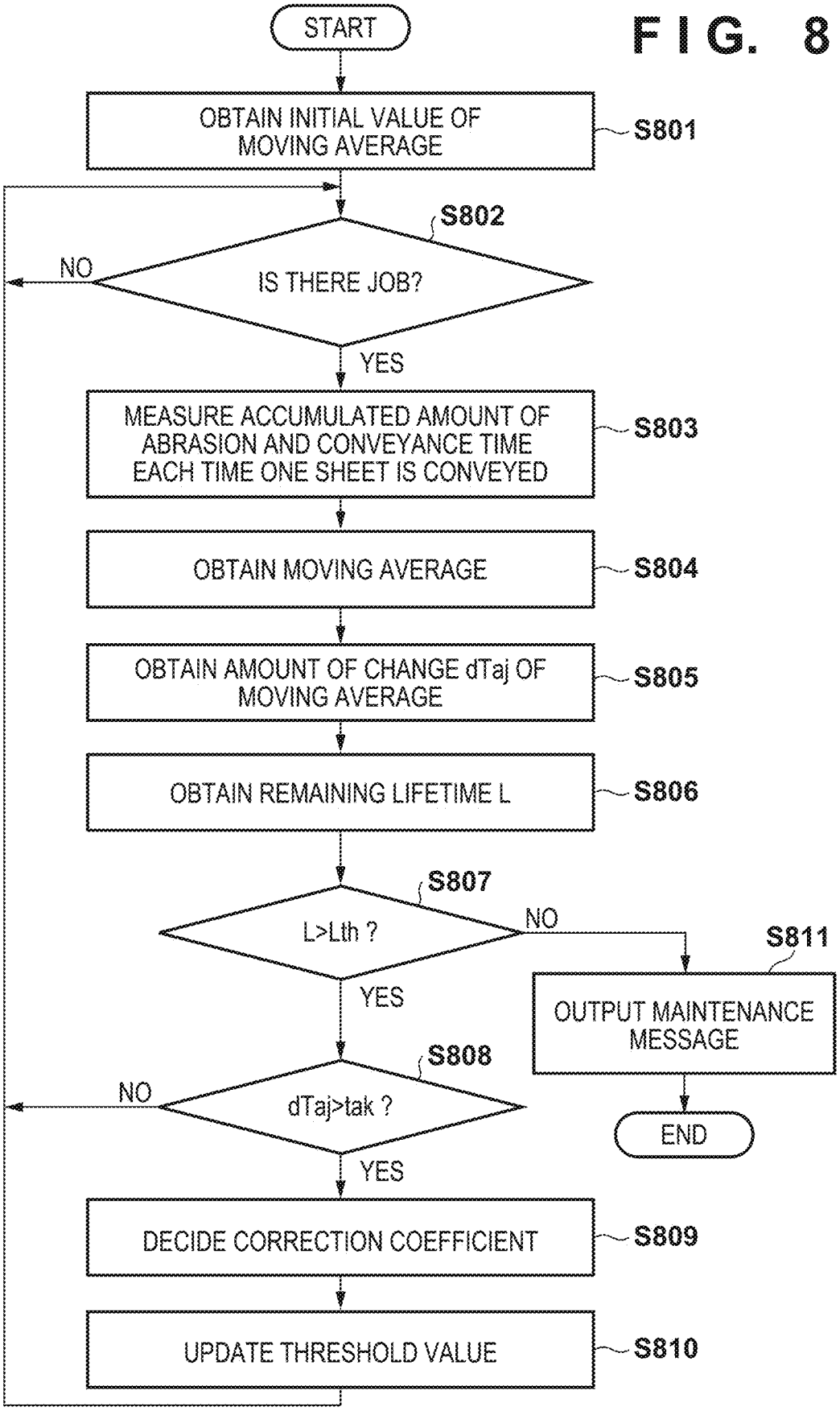
FIG. 8 is a flow chart illustrating a method of calculating a remaining lifetime.
Figure 9:
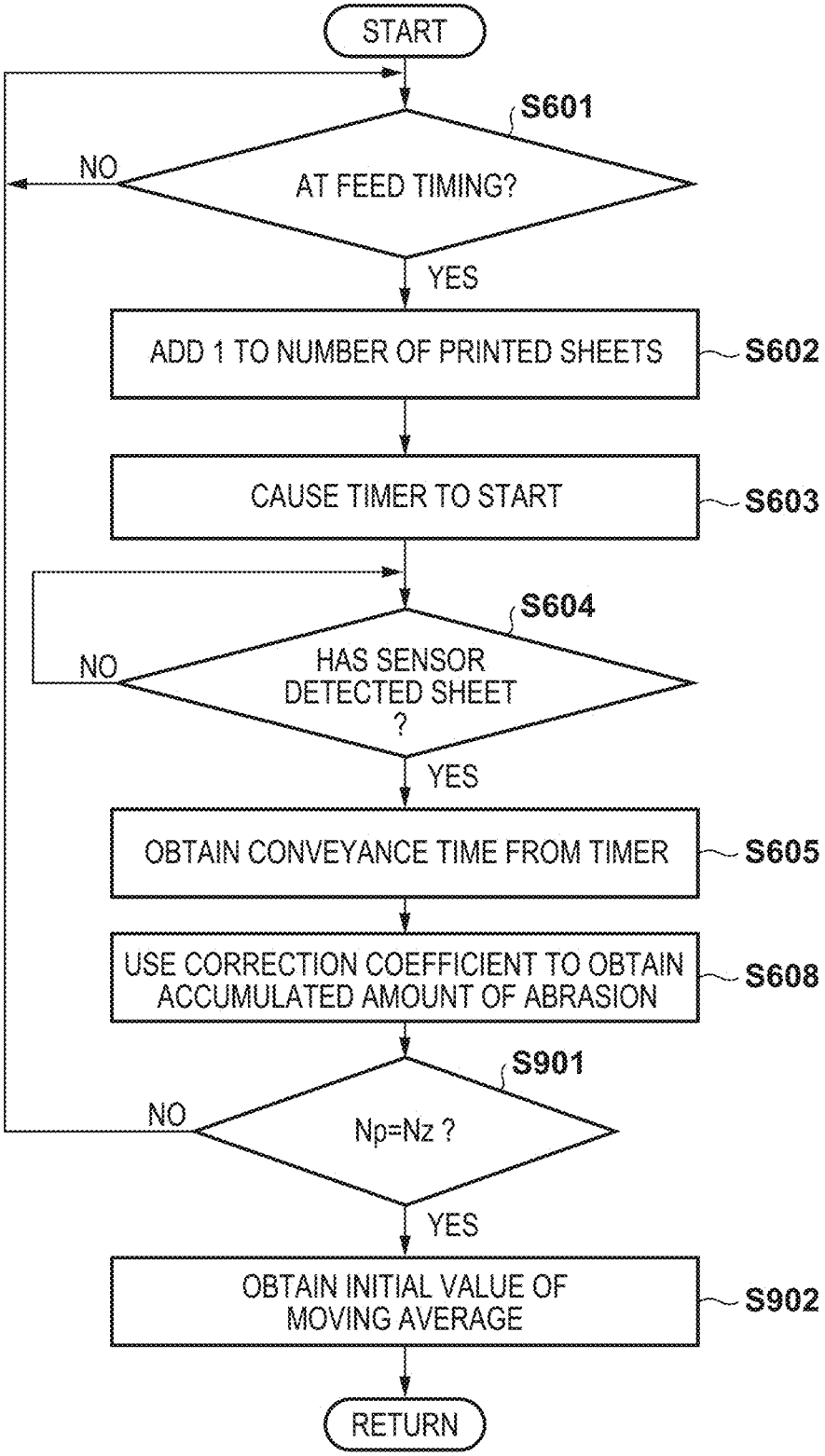
FIG. 9 is a flow chart showing a method of obtaining an initial value of a moving average.
Figure 10:
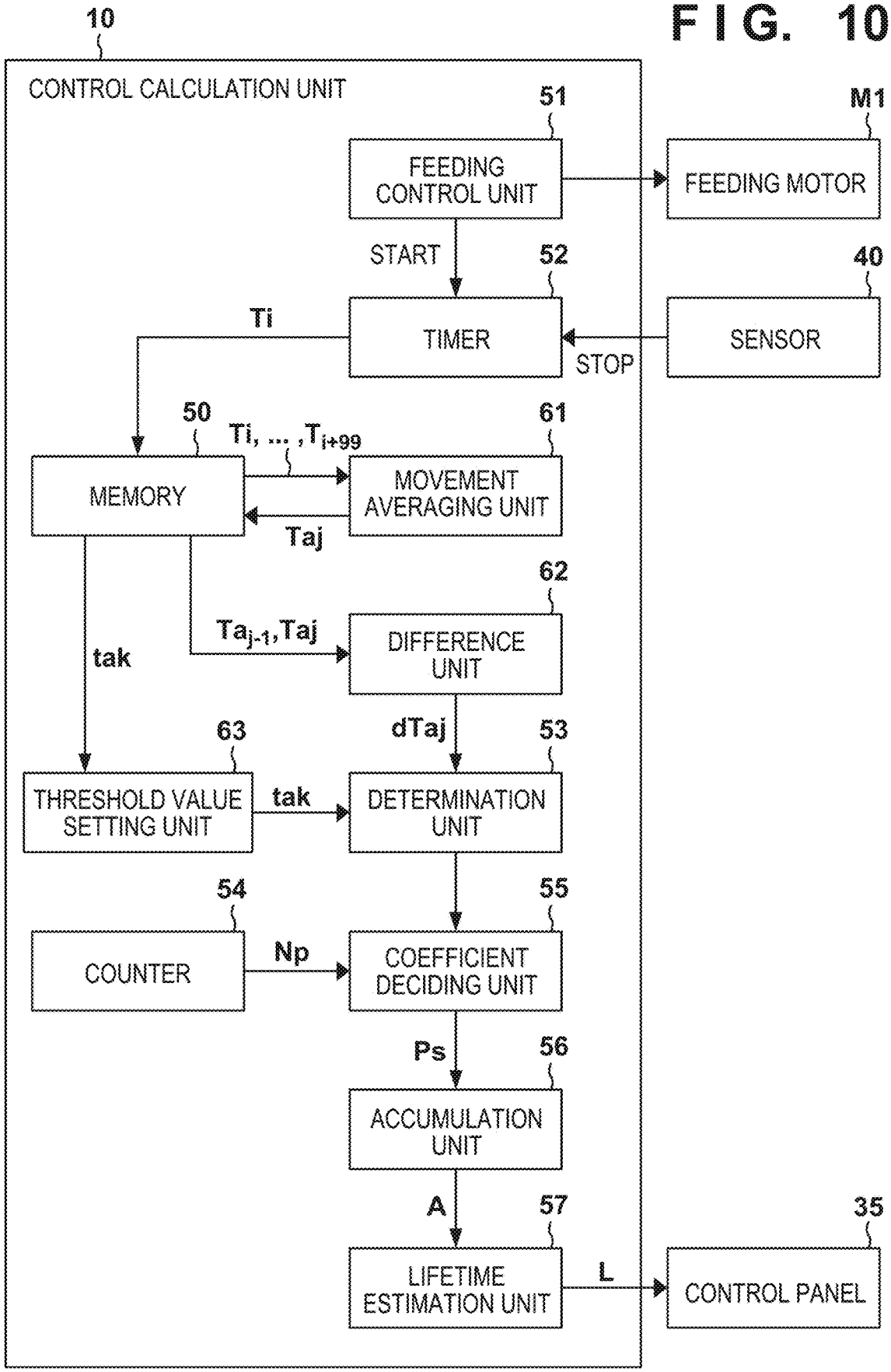
FIG. 10 is a block diagram showing functions of a control calculation unit.

FIG. 8 is a flow chart showing the lifetime estimation method of the first embodiment. FIG. 9 is a flow chart showing a method of obtaining an initial value of the moving average Ta of the conveyance time T. FIG. 10 is a block diagram illustrating functions of the control calculation unit 10.

In step S801, the movement averaging unit 61 obtains the initial value of the moving average Ta of the conveyance time T. Here, the initial value of the moving average Ta of Nz conveyance times T obtained from a predetermined number Nz of sheets P (e.g., 100 sheets) is obtained.

FIG. 9 differs from FIG. 6 in that step S606, step S607, and step S609 are deleted. The conveyance time T per sheet P is obtained in accordance with step S601 through step S605. The conveyance time of the i-th sheet P is denoted by Ti. In step S608, the accumulation unit 56 uses the initial correction coefficient to obtain the accumulated amount of abrasion A. In step S901, the control calculation unit 10 determines whether the number of printed sheets Np counted by the counter 54 has reached the predetermined number Nz. If the number of printed sheets Np has not reached the predetermined number Nz, the control calculation unit 10 returns to step S601. When number of printed sheets Np reaches the predetermined number Nz, the control calculation unit 10 proceeds to step S902. As a result, Nz conveyance times T1 to TNz are held in the memory 50. In step S902, the movement averaging unit 61 reads Nz conveyance times T1 to TNz from the memory 50, obtains an average value, and stores the average value in the memory 50. The average value is the initial value Tal of the moving average.

In step S802, the control calculation unit 10 determines whether or not there is a job instructed by the control panel 35. If there is a job, the control calculation unit 10 proceeds to step S803. In step S803, the accumulation unit 56 obtains the accumulated amount of abrasion A every time one sheet P is conveyed, and the timer 52 measures the conveyance time T. The initial value of correction coefficient Ps is 1.0. In step S804, the movement averaging unit 61 reads the latest Nz conveyance times T held in the memory 50 and obtains the moving average Taj. Like i, j is an index. In step S805, the difference unit 62 obtains the difference dTaj between the immediately preceding moving average Taj−1 and the current moving average Taj (dTaj=Taj−Taj−1). In step S806, the lifetime estimation unit 57 obtains the remaining lifetime L based on the accumulated amount of abrasion A and displays it on the display.

In step S807, the lifetime estimation unit 57 determines whether or not the remaining lifetime L exceeds the threshold value Lth. When the remaining lifetime L becomes equal to or less than the threshold value Lth, the control calculation unit 10 proceeds to step S811. In step S811, the lifetime estimation unit 57 displays a maintenance message on the display. The maintenance message is a message for prompting the replacement of the heating film 211, which is a conveyance part. In contrast, if the remaining lifetime L exceeds the threshold value Lth, the control calculation unit 10 proceeds to step S808.

In step S808, the determination unit 53 determines whether the amount of change dTaj exceeds the threshold value tak. Like i and j, k is an index. If the amount of change dTaj does not exceed the threshold value tak, the control calculation unit 10 returns to step S802. If the amount of change dTaj exceeds the threshold value tak, the control calculation unit 10 proceeds to step S809.

In step S809, the coefficient deciding unit 55 obtains, from the counter 54, the number of printed sheets Np for when the amount of change dTaj exceeded the threshold value tak, and decides the correction coefficient Ps based on the number of printed sheets Np. That is, the correction coefficient Ps is updated. FIG. 4B shows a table held in the memory 50 for converting the number of printed sheets Np to the correction coefficient Ps. The coefficient deciding unit 55 may refer to this table to decide the correction coefficient Ps based on the number of printed sheets Np. The accumulation unit 56 may obtain a first accumulated amount of abrasion A1 by multiplying the accumulated amount of abrasion A (a tentative accumulated value) from the first sheet to the Np-th sheet by the correction coefficient Ps. The accumulated amount of abrasion A2 for the Np+1 th sheet P is obtained using the most recent correction coefficient Ps (A2=A1+Ab×Ps).

In step S810, the threshold value setting unit 63 updates the threshold value tak. The threshold value setting unit 63 sequentially reads out x threshold values ta1 to tax held in the memories and sets them in the determination unit 53. For example, if the amount of change dTaj exceeds the threshold value ta1, the threshold value setting unit 63 sets the following threshold value ta2 to the determination unit 53. Similarly, if the amount of change dTaj exceeds the threshold value ta2, the threshold value setting unit 63 sets the following threshold value ta3 (ta1<ta2<ta3) to the determination unit 53. Thereafter, the control calculation unit 10 returns to step S802. Thus, if the amount of change dTaj exceeds the threshold value tak, the threshold value tak is switched to the following threshold value tak+1.

Specific Example

In order to explain the above procedures more clearly, a case where three threshold values ta1 to ta3 exist will be described. Until the amount of change dTa exceeds the threshold value ta1, 1.0 is used as the correction coefficient Ps, and the temporary accumulated amount of abrasion A1 is obtained based on Equation (1). If the amount of change dTa exceeds the threshold value ta1, then the correction coefficient Ps1 is determined using the current number of printed sheets Np1. The first accumulated amount of abrasion A1' is obtained by multiplying the temporary accumulated amount of abrasion A1 by the correction coefficient Ps1.

Thereafter, the correction coefficient Ps1 is used until the amount of change dTa exceeds the threshold value ta2, and the accumulated amount of abrasion A2 is obtained based on Equation (1). At this time, the remaining lifetime L2 is obtained by the following equation.

$$\text{Remaining lifetime } L2=(1-(A1'+A2)/23)\times 100 \quad (4)$$

If the amount of change dTa exceeds threshold value ta2, then the correction coefficient Ps2 is decided using the current number of printed sheets Np2. Here, the accumulated amount of abrasion A2 is a temporary accumulated amount of abrasion from the number of printed sheets Np1+1 to the number of printed sheets Np2. The coefficient deciding unit 55 obtains the difference dNp between the number of printed sheets Np2 and the number of printed sheets Np1, and decides the correction coefficient Ps2 corresponding to the difference dNp from a table or the like. Since the accumulated amount of abrasion A2 is a temporary value calculated using the correction coefficient Ps1, the value is corrected using the correction coefficient Ps2.

$$\text{Accumulated amount of abrasion } A2'=A2\times(Ps2/Ps1) \quad (5)$$

Thereafter, the correction coefficient Ps2 is used until the amount of change dTa exceeds the threshold value ta3, and the accumulated amount of abrasion A3 is obtained based on Equation (1). At this time, the remaining lifetime L3 is obtained by the following equation.

$$L3=(1-(A1'+A2'+A3)/23)\times 100 \quad (6)$$

If the amount of change dTa exceeds threshold value ta3, then correction coefficient Ps3 is decided using the current number of printed sheets Np3. Here, the accumulated amount of abrasion A3 is a temporary accumulated amount of abrasion from the number of printed sheets Np2+1 to the number of printed sheets Np3. The coefficient deciding unit 55 obtains the difference dNp between the number of printed sheets Np3 and the number of printed sheets Np2, and determines the correction coefficient Ps3 corresponding to the difference dNp from a table or the like. Since accumulated amount of abrasion A3 is a temporary value calculated using the correction coefficient Ps2, it is corrected using the correction coefficient Ps3. The corrected accumulated amount of abrasion A3' is obtained Equation (7).

$$A3'=A3\times(Ps3/Ps2) \quad (7)$$

Thereafter, the accumulated amount of abrasion A4 and a remaining lifetime L4 after the number of printed sheets Np3+1 are obtained using the correction coefficient Ps3.

Figure 5B:
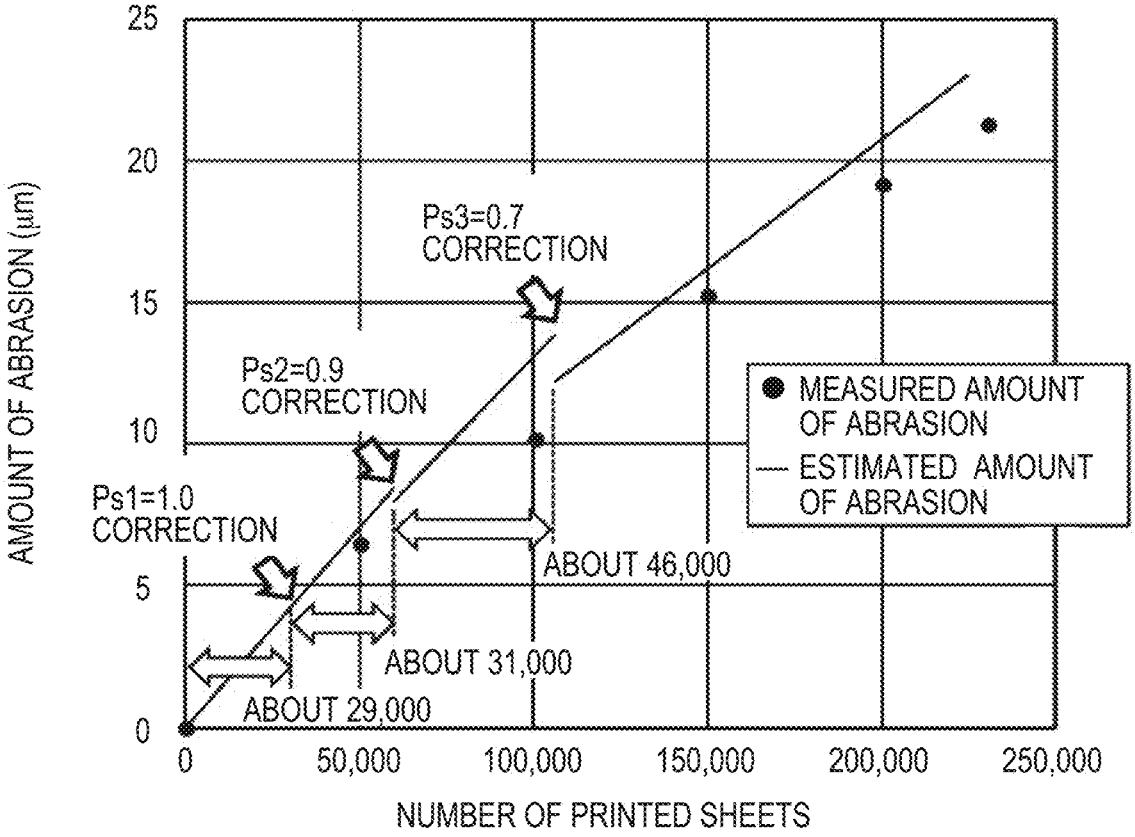

FIG. 5B shows the experimental results of the second embodiment. The vertical axis represents the amount of abrasion of a releasability layer. The horizontal axis represents a number of printed sheets. The solid line is the estimation value of the amount of abrasion. Plots are measured values of the amount of abrasion. The sheet Pa was used here. The amount of change dTa exceeded threshold value ta1 when the number of printed sheets Np reached about 29,000 sheets. Ps1 was determined to be 1.0 according to the table in FIG. 4B. This yields the corrected accumulated amount of abrasion A1' (here, A1'=A1 since the correction coefficient Ps1 was the same 1.0 as initial value).

Then, the sheet Pa was changed to the sheet Pb prior to the amount of change dTa exceeding the following threshold value ta2 (Np=50,000 sheets). Thereafter, the amount of change dTa exceeded the threshold value ta2 when approximately 10,000 sheets of the sheet Pb were printed (total: 60,000 sheets). Approximately 31,000 sheets have been printed since the amount of change dTa exceeded the threshold value ta1. The correction coefficient Ps2 was decided to be 0.9 according to the table in FIG. 4B. Accumulated amount of abrasion A2' is obtained using correction coefficient Ps2. When the number of printed sheets Np reached about 106,000 sheets, the amount of change dTa exceeded the threshold value ta3. Approximately 46,000 sheets have been printed since the amount of change dTa exceeded threshold value ta2 (106,000-60,000=46,000). The correction coefficient Ps3 was determined to be 0.7 according to the table in FIG. 4B. The accumulated amount of abrasion A3' is obtained using the correction coefficient Ps3. In addition, the accumulated amount of abrasion A4 is obtained using the correction coefficient Ps3.

When the total value of the accumulated amount of abrasion A (A1'+A2'+A3'+A4) exceeded the lifetime value Lth of 23 [um], the number of printed sheets Nps was about 225,000. Meanwhile, the measured amount of abrasion is plotted for each of 50,000 sheets P. A measured value for the amount of abrasion when the estimated remaining lifetime L reached 0 was 21.3 [um]. As described above, even if the type of sheet is changed, the amount of abrasion of the releasability layer is accurately estimated. Therefore, the accuracy of calculating the remaining lifetime of the fixing device 27 is also improved. According to the present embodiment, even if the tendency of the conveyance time T is changed by changing the type of the sheet P, the degree of degradation of the fixing device 27 can be accurately estimated. That is, the remaining lifetime of the fixing device 27 can be accurately estimated according to the type of the sheet P used by the user.

In the second embodiment, three threshold values ta1 to ta3 are used, but the number of threshold values ta may be two or four or more. As the number of threshold values ta is increased, the remaining lifetime can be estimated more accurately.

A moving average has been employed as a technique for reducing the effect of the variation in the conveyance time T, but this is only an example. Instead of the amount of change dTa of the moving average Ta, the amount of change dT of the conveyance time T may be adopted. The correction coefficient Ps may be determined when the conveyance time T consecutively exceeds a threshold value n times.

In the second embodiment, when the amount of change dTa exceeds the threshold value ta, the correction coefficient Ps is updated and accumulated amount of abrasion and remaining lifetime are corrected. Therefore, the remaining lifetime displayed on the control panel 35 before and after the corrections may be discontinuous. In order to mitigate discontinuities, for example, an interpolation calculation may be employed that complements an uncorrected remaining lifetime with the corrected remaining lifetime.

Third Embodiment

The third embodiment is a technical concept derived from the first and second embodiments. The pickup roller 14 and the feed roller pairs 17 and 18 are examples of a first conveyance part that contacts a sheet in a first conveyance section and conveys the sheet. The first conveyance section is, for example, a section from the pickup roller 14 to the detection position of the sensor 40 in the conveyance path. The heating rotary member 22 is provided in a second conveyance section which is downstream of the first conveyance section in a conveyance direction of the sheet, and is an example of a second conveyance part for conveying the sheet. It should be noted that the heating rotary member 22 is provided on downstream of the sensor 40 in the conveyance direction of the sheet. The second conveyance section may be a section that is downstream of the registration roller pair 19 in the conveyance path. The timer 52 functions as a measurement unit for measuring the conveyance time of the sheet from the start of the conveyance of the sheet by the first conveyance part to the detection of the leading edge of the sheet by the detection unit. That is, the timer 52 is an exemplary measurement unit for measuring the conveyance time T of a sheet between two points in the first conveyance section. The control calculation unit 10 is an example of an estimation unit for estimating the remaining lifetime of a second conveyance part based on conveyance time regarding a first conveyance part. Conventionally, the remaining lifetime of the first conveyance part itself is obtained based on the conveyance time of the first conveyance part, and the remaining lifetime of the second conveyance part could not be obtained. Conventionally, the smoothness and the basis weight of a sheet is detected, and the remaining lifetime of the second conveyance part is estimated based on the smoothness and the basis weight. In contrast, according to the present invention, the remaining lifetime of the second conveyance part can be estimated based on the conveyance time associated with the first conveyance part. As a result, by virtue of the present invention, the lifetime of the second conveyance part can be more accurately estimated in comparison with the prior art.

As shown in FIG. 7 and FIG. 10, the determination unit 53, the coefficient deciding unit 55, and the like are examples of a conversion unit for converting the conveyance time T into the correction coefficient Ps. The accumulation unit 56 is an example of a correction unit for correcting the amount of abrasion of the second conveyance part using correction coefficient. The lifetime estimation unit 57 is an example of a calculation unit for calculating the remaining lifetime of the second conveyance part based on the amount of abrasion of the second conveyance part corrected by the correction unit.

As shown by Equation (1) and the like, the accumulation unit 56 may include an accumulation unit that multiplies a unit amount of abrasion per sheet or a unit amount of abrasion per revolution of the first conveyance part by a correction coefficient and accumulates the multiplication result.

The counter 54 is an example of a counting unit for counting the number of revolutions of the first conveyance part or the number of sheets printed by the image forming apparatus 100. When the conveyance time T exceeds the threshold value th1, the coefficient deciding unit 55 may obtain the count value of the counting unit and convert the count value to a correction coefficient. As shown in FIG. 4A and the like, the coefficient deciding unit 55 has a table for converting the count value into a correction coefficient, and the count value may be converted into a correction coefficient using the table.

As described in the second embodiment, the difference unit 62 is an example of an obtainment unit that obtains a transition parameter (e.g., dTa) indicative of the transition of conveyance time T. The coefficient deciding unit 55 and the determination unit 53 may obtain the count value of the counting unit and convert the count value into a correction coefficient when the transition parameter exceeds the threshold value tak. As described above, the transition of the conveyance time T reflects the usage of the image forming apparatus 100 by respective users (for example, usage of different types of sheets P). Therefore, the remaining lifetime of the second conveyance part can be accurately obtained by considering the transition of the conveyance time T.

As described in the second embodiment, when the transition parameter exceeds the first threshold value ta1, the coefficient deciding unit 55 may obtain a count value of the counting unit and decide the correction coefficient based on the count value. When the transition parameter exceeds the second threshold value ta2 which is larger than the first threshold value, the coefficient deciding unit 55 may obtain a count value of the counting unit and change the correction coefficient based on the count value. When the transition parameter exceeds the third threshold value ta3 which is larger than the second threshold value, the coefficient deciding unit 55 may obtain the count value of the counting unit and change the correction coefficient based on the count value.

As described in second embodiment, the accumulation unit 56 may obtain the accumulated amount of abrasion of the second conveyance part using the tentative correction coefficient in the first period, which is the period for until the transition parameter exceeds the first threshold value. In this instance, the accumulation unit 56 corrects the accumulated amount of abrasion in the first period with the first correction coefficient which is determined by the transition parameter exceeding the first threshold value. The accumulation unit 56 uses the first correction coefficient as a tentative correction coefficient during a second period from when the transition parameter exceeds the first threshold value to when it exceeds the second threshold value to obtain the accumulated amount of abrasion of the second conveyance part in the second period. The accumulation unit 56 corrects the accumulated amount of abrasion in the second period by a second correction coefficient which is decided by the transition parameter exceeding the second threshold value. The accumulation unit 56 uses the second correction coefficient as a tentative correction coefficient in a third period from when the transition parameter exceeds the second threshold value to when it exceeds the third threshold value to obtain the accumulated amount of abrasion of the second conveyance part in the third period. In addition, the accumulation unit 56 corrects the accumulated amount of abrasion in the third period by a third correction coefficient determined by the transition parameter exceeding the third threshold value.

As described in the second embodiment, the transition parameter may be a difference between the statistic value of the conveyance time T obtained for the j−1-th sheet and the statistic value of the conveyance time obtained for the j-th sheet. For example, the statistic value is a moving average. The communication circuits connected to the display apparatus and networks of the control panel 35 are examples of an output unit that outputs a remaining lifetime. The output unit may output information regarding maintenance of the second conveyance part when the remaining lifetime is less than or equal to the lifetime threshold value. This will make it easier for users and maintenance personnel to understand the remaining lifetime and maintenance timing of the second conveyance part.

There are many different timings for estimating remaining lifetime. As described in the first and second embodiments, each time a sheet is conveyed in the image forming apparatus 100, the measurement unit may measure the conveyance time T and the estimation unit may estimate the remaining lifetime L based on the conveyance time. Alternatively, when the number of printed sheets P reaches predetermined number of sheets, the measurement unit may measure the conveyance time T and the estimation unit may estimate the remaining lifetime L based on the conveyance time.

The sensor 40 is an example of a detection unit for detecting sheets conveyed in the first conveyance section. The timer 52 may measure the time from a timing when a feed instruction is issued to a timing when the detection unit detects a sheet as a conveyance time. That is, the timer 52 may initiate measurement when a feed instruction is issued. As noted in first embodiment, the sensor 40 may be installed at any two locations in the conveyance path. One of the sensors 40 is installed at one of the two points, and is an example of a first detection unit for detecting sheets. The other sensor 40 is installed at the other of the two points, and is an example of a second detection unit for detecting sheets. The timer 52 may measure the time from when the first detection unit detects the leading edge of a sheet to when the second detection unit detects the leading edge of the sheet as a conveyance time.

As noted in the first embodiment, the encoder provided in the feed roller pair 17 is an example of a measurement unit for measuring the conveyance speed of a sheet by the first conveyance part. The control calculation unit 10 is an example of an estimation unit for estimating the remaining lifetime of the second conveyance part based on the conveyance speed for the first conveyance part.

The remaining lifetime L may be the remaining thickness of a releasability layer of the second conveyance part. The remaining lifetime L may be the number of days the second conveyance part is available before the lifetime of the second conveyance part is exhausted. The remaining lifetime L may be the number of sheets that can be printed by the image forming apparatus before the lifetime of the second conveyance part is exhausted.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-130882, filed Jul. 10, 2018, which is hereby incorporated by reference herein in its entirety.

What is claimed is:

1. An image forming apparatus comprising:

a first conveyance part configured to convey a sheet;

a detection unit configured to detect the sheet conveyed by the first conveyance part;

a second conveyance part provided downstream of the detection unit in a conveyance direction of the sheet, and configured to convey the sheet;

a measurement unit configured to measure a conveyance time of the sheet from when conveyance of the sheet by the first conveyance part is started until the sheet is detected by the detection unit; and an estimation unit configured to estimate a remaining lifetime of the second conveyance part based on the conveyance time measured by the measurement unit, wherein the estimation unit includes:

a conversion unit configured to convert the conveyance time to a correction coefficient;

a correction unit configured to correct an amount of abrasion of the second conveyance part using the correction coefficient; and a calculation unit configured to calculate a remaining lifetime of the second conveyance part based on the amount of abrasion of the second conveyance part corrected by the correction unit.

2. The image forming apparatus according to claim 1, wherein the correction unit includes:

an accumulation unit configured to multiply a unit amount of abrasion per sheet or a unit amount of abrasion per revolution of the first conveyance part by the correction coefficient, and accumulate multiplication results.

3. The image forming apparatus according to claim 1, further comprising a counting unit configured to count a number of sheets printed by the image forming apparatus or a number of revolutions of the first conveyance part, wherein, when the conveyance time exceeds a threshold value, the conversion unit obtains a count value of the counting unit and converts the count value to the correction coefficient.

4. The image forming apparatus according to claim 3, wherein the conversion unit has a table for converting the count value to the correction coefficient, and uses the table to convert the count value to the correction coefficient.

5. The image forming apparatus according to claim 1, further comprising:

a counting unit configured to count a number of printed sheets for the image forming apparatus or a number of revolutions of the first conveyance part; and an obtainment unit configured to obtain a transition parameter indicating a transition of the conveyance time, wherein, when the transition parameter exceeds a threshold value, the conversion unit obtains a count value of the counting unit and converts the count value to the correction coefficient.

6. The image forming apparatus according to claim 5, wherein the transition parameter is a difference between a statistic value of the conveyance time obtained for a j−1-th sheet and a statistic value of the conveyance time obtained for a j-th sheet.

7. The image forming apparatus according to claim 6, wherein the statistic value is a moving average.

8. The image forming apparatus according to claim 1, further comprising:

a counting unit configured to count a number of sheets printed by the image forming apparatus or a number of revolutions of the first conveyance part; and an obtainment unit configured to obtain a transition parameter indicating a transition of the conveyance time, wherein the conversion unit, when the transition parameter exceeds a first threshold value, obtains a count value of the counting unit and decides the correction coefficient based on the count value, and, when the transition parameter exceeds a second threshold value greater than the first threshold value, obtains a count value of the counting unit and changes the correction coefficient based on the count value.

9. The image forming apparatus according to claim 8, wherein the correction unit obtains an accumulated amount of abrasion of the second conveyance part using a temporary correction coefficient in a first period which is until the transition parameter exceeds the first threshold value, corrects the accumulated amount of abrasion in the first period with a first correction coefficient decided by the transition parameter exceeding the first threshold value, obtains the accumulated amount of abrasion of the second conveyance part in a second period from when the transition parameter exceeds the first threshold value until the transition parameter exceeds the second threshold value using the first correction coefficient as a temporary correction coefficient in the second period, and corrects the accumulated amount of abrasion in the second period in accordance with a second correction coefficient decided by the transition parameter exceeding the second threshold value.

10. The image forming apparatus according to claim 1, further comprising:

a counting unit configured to count a number of sheets printed by the image forming apparatus or a number of revolutions of the first conveyance part; and an obtainment unit configured to obtain a transition parameter indicating a transition of the conveyance time, wherein the conversion unit, when the transition parameter exceeds a first threshold value, obtains a count value of the counting unit and determines the correction coefficient based on the count value, when the transition parameter exceeds a second threshold value greater than the first threshold value, obtains a count value of the counting unit and changes the correction coefficient based on the count value, and, when the transition parameter exceeds a third threshold value greater than the second threshold value, obtains a count value of the counting unit and changes the correction coefficient based on the count value.

11. The image forming apparatus according to claim 10, wherein the correction unit:

obtains an accumulated amount of abrasion of the second conveyance part using a temporary correction coefficient in a first period which is until the transition parameter exceeds the first threshold value, correcting the accumulated amount of abrasion in the first period by a first correction coefficient that is decided by the transition parameter exceeding the first threshold value, obtains an accumulated amount of abrasion of the second conveyance part in a second period, which is from when the transition parameter exceeds the first threshold value to when the transition parameter exceeds the second threshold value, using the first correction coefficient as a tentative correction coefficient in the second period and corrects the accumulated amount of abrasion in the second period by a second correction coefficient decided by the transition parameter exceeding the second threshold value, and obtains an accumulated amount of abrasion of the second conveyance part in a third period, which is from when the transition parameter exceeds the second threshold value to when the transition parameter exceeds the third threshold value, using the second correction coefficient as a temporary correction coefficient in the third period, and corrects the accumulated amount of abrasion in the third period by a third correction coefficient decided by the transition parameter exceeding the third threshold value.

12. The image forming apparatus according to claim 1, further comprising an output unit configured to output the remaining lifetime.

13. The image forming apparatus according to claim 12, wherein the output unit outputs information regarding maintenance of the second conveyance part when the remaining lifetime is less than or equal to a lifetime threshold value.

14. The image forming apparatus according to claim 1, wherein, when a number of printed sheets reaches a predetermined number of sheets, the measurement unit measures the conveyance time and the estimation unit estimates the remaining lifetime based on the conveyance time.

15. The image forming apparatus according to claim 1, wherein each time a sheet is conveyed by the image forming apparatus, the measurement unit measures the conveyance time and the estimation unit estimates the remaining lifetime on the basis of the conveyance time.

16. The image forming apparatus according to claim 1, wherein the measurement unit starts measuring the conveyance time when a feed instruction is issued.

17. The image forming apparatus according to claim 1, wherein of the remaining lifetime is a remaining thickness of a releasability layer of the second conveyance part, a number of days in which the second conveyance part can be used before a lifetime of the second conveyance part is exhausted, or a number of sheets that can be printed by the image forming apparatus before the lifetime of the second conveyance part is exhausted.

18. An image forming apparatus comprising:

a first conveyance part configured to convey a sheet;

a first detection unit configured to detect the sheet conveyed by the first conveyance part;

a second detection unit provided downstream of the first detection unit in a conveyance direction of the sheet and configured to detect the sheet conveyed by the first conveyance part;

a second conveyance part provided downstream of the second detection unit in the conveyance direction of the sheet and configured to convey the sheet;

a measurement unit configured to measure a conveyance time of the sheet from when the sheet is detected by the first detection unit until when the sheet is detected by the second detection unit; and an estimation unit configured to estimate a remaining lifetime of the second conveyance part based on the conveyance time measured by the measurement unit, wherein the estimation unit includes:

a conversion unit configured to convert the conveyance time to a correction coefficient;

a correction unit configured to correct an amount of abrasion of the second conveyance part using the correction coefficient; and a calculation unit configured to calculate a remaining lifetime of the second conveyance part based on the amount of abrasion of the second conveyance part corrected by the correction unit.

19. An image forming apparatus comprising:

a first conveyance part configured to convey a sheet;

a second conveyance part provided downstream of the first conveyance part in a conveyance direction of the sheet, and configured to convey the sheet;

a measurement unit configured to measure a conveyance speed of the sheet by the first conveyance part; and an estimation unit configured to estimate a remaining lifetime of the second conveyance part based on the conveyance speed measured by the measurement unit, wherein the estimation unit includes:

a conversion unit configured to convert the conveyance speed to a correction coefficient;

a correction unit configured to correct an amount of abrasion of the second conveyance part using the correction coefficient; and a calculation unit configured to calculate a remaining lifetime of the second conveyance part based on the amount of abrasion of the second conveyance part corrected by the correction unit.

* * * * *